United States Patent [19]

Harper et al.

[11] Patent Number: 4,977,408

[45] Date of Patent: Dec. 11, 1990

[54] DEPLOYABLE ANTENNA BAY

[75] Inventors: Jack D. Harper, West Windsor Township, Mercer County; Richard W. Clayton, Medford, both of N.J.; Philip Olikara, Lower Makefield Township, Bucks County, Pa.

[73] Assignee: General Electric Company, East Windsor, N.J.

[21] Appl. No.: 372,747

[22] Filed: Jun. 28, 1989

[51] Int. Cl.[5] ..... H01Q 1/12; H01Q 11/10

[52] U.S. Cl. ..... 343/792.5; 343/876; 343/880

[58] Field of Search ..... 343/877, 880, 878, 887–889, 343/915, 792.5; 242/54 A

[56] References Cited

U.S. PATENT DOCUMENTS

| | | | |
|---|---|---|---|
| 2,565,661 | 8/1951 | Lidz | 343/877 |
| 3,210,767 | 10/1965 | Isbell | 343/792.5 |
| 3,465,567 | 9/1969 | Park | 343/877 |
| 3,524,190 | 8/1970 | Killion et al. | 343/880 |
| 4,447,816 | 5/1984 | Kurina et al. | 343/877 |
| 4,593,290 | 6/1986 | Wojtowicz | 343/709 |

FOREIGN PATENT DOCUMENTS

| | | | |
|---|---|---|---|
| 2109637 | 6/1983 | United Kingdom | 343/877 |

OTHER PUBLICATIONS

"Space Antenna Selection and Design" by Brown et al., published in the Oct., 1965 issue of SYSTEMS DESIGN magazine.

Antenna Engineering Handbook, edited by Jasik, first edition, published by McGraw-Hill, 1961, Chapter 18.

*Primary Examiner*—Michael C. Wimer

*Attorney, Agent, or Firm*—William H. Meise

[57] ABSTRACT

A deployable crossed log periodic dipole array is made up of a plurality of bays spaced along a feed transmission line arrangement. Each bay includes a support centered on the array axis. Each bay also includes as antenna elements four long, straight, flat or slightly bowed springs or spring-like tape elements, each fastened at one end to a transmission line conductor. A retainer associated with each bay is rotatable about the cylindrical support and engages the spring elements, so that rotation of the retainer winds the spring elements against the spring resistance and stores energy therein. A locking arrangement simultaneously engages or disengages all the retainers. Simultaneous unlocking of the retainers allows the springs of all the bays to rotate the retainers and to unwind. As the springs unwind, they deploy. The transmission line arrangement includes two open two-wire transmission lines on a common axis. To reduce torques during deployment, each bay contrarotates relative to an adjacent bay. The locking arrangement is a longitudinal rod with projecting pins which can simultaneously engage the support structure and the rotatable retainer. The rod is actuated by a cam in a hinge.

17 Claims, 9 Drawing Sheets

DEPLOYABLE ANTENNA BAY

The government has rights in this invention pursuant to Contract Number F04701-888-C-0047 with the Air Force.

BACKGROUND OF THE INVENTION

Among the classes of so-called "frequency independent" antennas are the equiangular antennas and the log-periodic antennas. Log-periodic antennas are so termed because any portion of the structure may be scaled so that the electrical properties repeat periodically with the logarithm of the frequency. In principle, such antennas may be arranged to have any desired bandwidth, but in practice the bandwidth is limited by the manufacturing tolerances possible at the high frequency end, and the low frequency is ordinarily limited by the space required for the low-frequency antenna elements Frequency-independent and log- periodic antennas are well known in the art and are described, for example, in the text "Antenna Engineering Handbook" edited by Jasik, published by McGraw-Hill.

A particular type of log-periodic antenna is described in U.S. Pat. No. 3,210,767 issued Oct. 5, 1965 to Isbell. The Isbell antenna is a planar (all dipole elements lying substantially in one plane) log periodic including a number of bays of half-wave dipoles fed by what amounts to an elongated balanced two-wire or two-conductor transmission line. The lengths of the dipole elements taper from a maximum at the low-frequency end to a minimum at the high-frequency or "feed" end.

Those skilled in the art know that antennas are reciprocal passive devices in which various properties are identical in both the transmitting and receiving modes. For example, the directivity and beamwidth are identical in both transmitting and receiving modes of operation. Ordinarily, description of antenna operation is couched in terms of either transmission or reception, the other operation being understood.

When the feed transmission line of the Isbell antenna is fed with signal at a frequency near the center of the operating frequency band from the side of the transmission line having the relatively smaller dipole elements, the signal propagates along the transmission line. When propagating past the relatively small dipole elements near the feed point, the signal "sees" the dipole elements as relatively small capacitances which shunt the effective capacitance of the transmission line. The small radiating elements have relatively small radiation resistance in series with the relatively large reactance of the equivalent capacitance, and therefore radiate very little energy. Thus, the signal effectively propagates along the transmission line unaffected by the small dipole elements. Eventually, the signal reaches regions in which the dipole elements coupled to the transmission line have lengths of approximately $\lambda/4$ ($\lambda/2$ for the entire dipole). In these regions, the propagating signal "sees" real dipole impedances or radiation resistances coupled across the impedance of the transmission line. The dipole impedances are of the same order of magnitude as the characteristic impedance of the transmission line. Consequently, at frequencies at which the dipole elements are approximately $\lambda/2$ long, energy is coupled from the transmission line to the elements and radiated thereby. The log periodic dipole array is arranged so that more than one dipole receives significant energy at any midband operating frequency, so that an array of elements is formed for radiation at that frequency. The arraying of the elements and their relative phases results in radiation back toward the feed. Thus, a radiated beam is formed in the direction in which the array "points", viewing the array as a whole as an arrowhead pointing in a given direction. If energy were to propagate past the region in which the dipoles are about $\lambda/2$ long, it would encounter dipoles which approach lengths at which they individually produce multiple-lobed patterns and have impedances which couple energy from the transmission lines. However, most of the signal energy applied at the feed point is coupled out within the $\lambda/2$ dipole region, so little energy remains to flow to the relatively large dipoles, the radiation of which might perturb the desired antenna radiation pattern.

As so far described, the Isbell log periodic dipole produces a singly polarized signal. Antennas of the general type described by Isbell have been used for the horizontally polarized television receiving antennas, for broadband communication and the like. U.S. Pat. Application Ser. No. 06/936,499 filed Dec. 1, 1986 in the name of Balcewicz describes the simultaneous use of two orthogonal linear polarizations for communication between widely spaced Earth stations. As mentioned in U.S. Pat. No. 4,590,480 issued May 20, 1986 in the name of Nikolayuk et al, singly-polarized or horizontally-polarized signals may not be optimum under all circumstances for television purposes. As mentioned therein, attention has been directed to the broadcasting of circularly polarized signals from a television transmitter in order to reduce the effects of ghosting and to provide uniformity of coverage. Orthogonally crossed log periodic dipole arrays as described in the article "Space Antenna Selection and Design" by Brown et al, published in the Oct. 1965 issue of Systems Design magazine, have long been known to be useful for simultaneous orthogonal linear polarization or, in conjunction with couplers for providing a quadrature phase shift, for transducing circularly polarized or elliptically polarized signals.

The crossed log periodic dipole array antenna when fully deployed, as illustrated in the Brown et al article, includes a transmission line arrangement having an axis which lies parallel to the direction of electromagnetic propagation and also includes two mutually orthogonal $\lambda/2$ dipole antennas at each of multiple bays. The dipole antennas at one end of the array have lengths of about $\lambda/2$ at the highest frequency of operation, and at the other end of the array have lengths of $\lambda/2$ at the low frequency of the operating frequency band. Such an arrangement when in its deployed state may be difficult to mount in position. For example, for VHS television purposes in the United States, each of the two crossed dipoles at the low frequency end of the log periodic array may be ten or more feet long, and when one of the dipoles is horizontal, the other is vertical. Such a structure is very awkward to store or manipulate. It is known to hinge each dipole element near its juncture with the transmission line in order to ease the storage problem. However, the problem of awkwardness in handling reappears once it is deployed ready for mounting. An automatic arrangement for deploying an antenna element is desirable, and especially one which is suitable for deploying the elements of a crossed log periodic dipole array.

SUMMARY OF THE INVENTION

A deployable antenna apparatus includes an elongated, electrically conductive first spring or spring-like tape element. In one embodiment, the spring has a natural or unstressed cross section in a plane perpendicular to the axis of elongation which is bowed or curved. The apparatus also includes a generally cylindrical support structure defining a second axis and a support surface. A mechanical coupling arrangement is provided for coupling a first end of the spring to a first location on the cylinder, with the axis of elongation of the spring lying in a plane perpendicular to the second axis. A feed conductor is coupled to the spring near the first end. A retainer includes first and second generally flat annular sides spaced apart by a circumferential band. The first and second annular sides each define a central aperture rotatably bearing against the support surface. The circumferential band defines a first orifice larger than the cross section of the spring. The spring extends through the first orifice. Rotation of the retainer relative to the support structure caused the spring to wind about the support structure, flattening the bowing or curvature of the spring cross-section in at least a part of the spring which is wound about the support structure. Winding the spring around the support structure stores energy in the spring which is recovered during deployment. In another embodiment of the invention, a second orifice is defined in the circumferential band at a location diametrically opposed to the first orifice, relative to the second axis. A second spring extends through the second orifice and is fastened to the support structure.

DESCRIPTION OF THE INVENTION

Figures 1A, 1B:
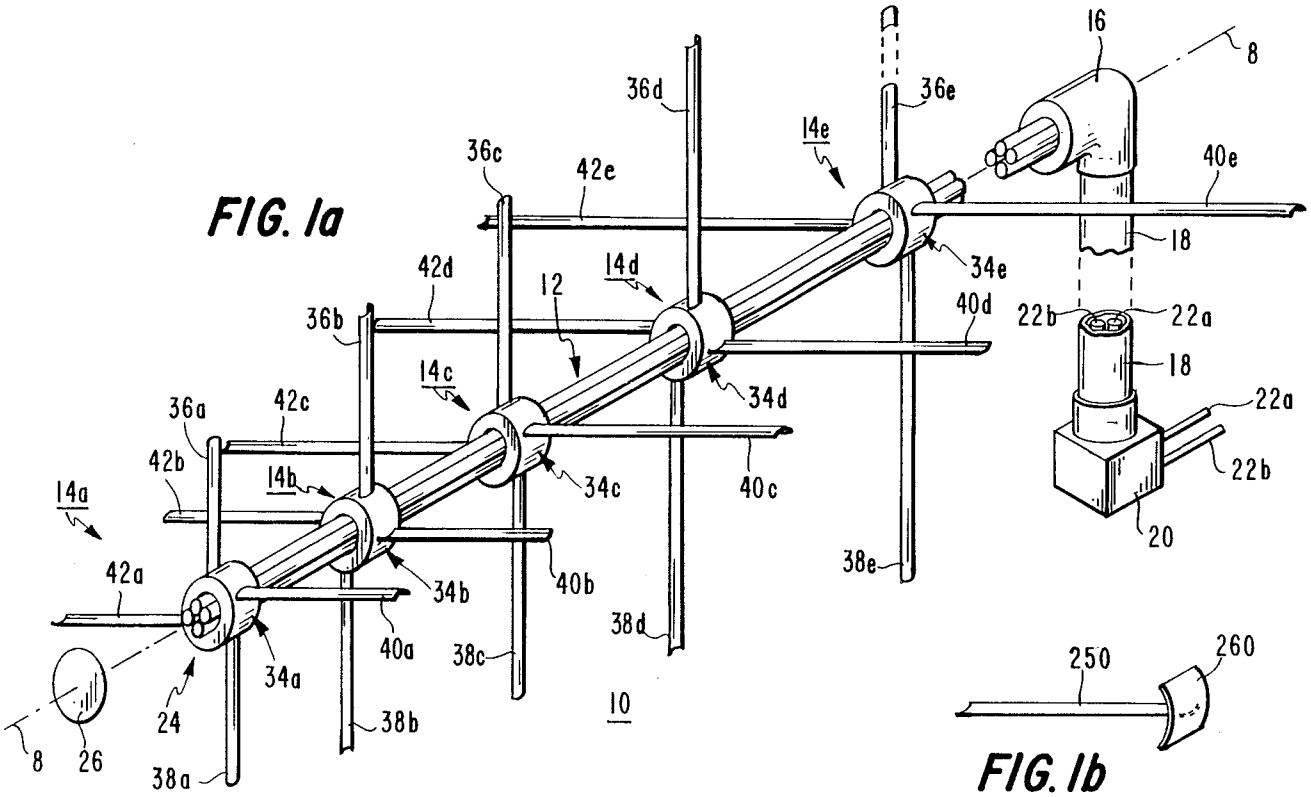
FIG. 1*a* is a perspective or isometric view of an antenna according to the invention, partially exploded and partially cut away.
FIG. 1*b* illustrates a dipole element with conformal end loading.

In FIG. 1*a*, a crossed log periodic dipole array antenna assembly designated generally as 10 includes a feed and support structure 12 centered on an axis 8. Assembly 12 provides for signal transmission and support of a plurality of bays 14*a*, 14*b*, 14*c*, 14*d* and 14*e* of antenna 10. At one end of feed and support structure 12, a mechanical support elbow 16 connects by a support pipe 18 to a hinge 20. Hinge 20 is connected to a further support, not illustrated. Flexible coaxial cables 22*a* and 22*b* pass through hinge 20, support pipe 18 and elbow 16, and, as described in detail below, through conductive tubes of feed and support structure 12 to a feed end 24 of the antenna remote from elbow 16. In FIG. 1*a*, a dielectric protective cap 26 is illustrated as being exploded away from feed end 24.

Bay 14*a* includes a central support structure 34*a*, together with an upper vertical dipole element 36*a* and a lower vertical dipole element 38*a*, a right horizontal dipole 40*a* and a left horizontal dipole 42*a*. The dipole elements may be made from copper-coated spring steel. The terms horizontal and vertical have no particular significance and are selected merely to identify locations as illustrated in FIG. 1. Vertical dipole elements 36*a* and 38*a* each have a length of about $\lambda/4$, so that the vertical dipole including elements 36*a* and 38*a* has a total length of about $\lambda/2$ at a frequency near the highest frequency of operation of log periodic dipole array 10. Similarly, horizontal dipole elements 40*a* and 42*a* each have a length of about $\lambda/4$ so the horizontal dipole has a dimension of about $\lambda/2$ at the same frequency. Antenna bay 14*b* includes upper and lower vertical dipole elements 36*b* and 38*b*, and right and left horizontal elements 40*b* and 42*b*, all extending from a central support structure 34*b*. The dipole elements of bay 14*b* are longer than those of bay 14*a* by a factor of tau ($\tau$), as described in the Isbell patent. Bay 14*c* includes a central bay structure 34*c*, vertical dipole elements 36*c* and 38*c*, and horizontal dipole elements 40*c* and 42*c*, which elements are $\tau$ larger than the elements of bay 14*b*. Bay 14*d* includes central bay structure 34*d*, vertical elements 36*d* and 38*d*, and horizontal elements 40*d* and 42*d*, which are factor $\tau$ larger than the elements of bay 14*c*. As can e seen from the sections of the dipole elements in FIG. 1, the elements are bowed when viewed in a plane orthogonal to their axes of elongation, much like the bowing of a steel measuring tape.

Figure 2:
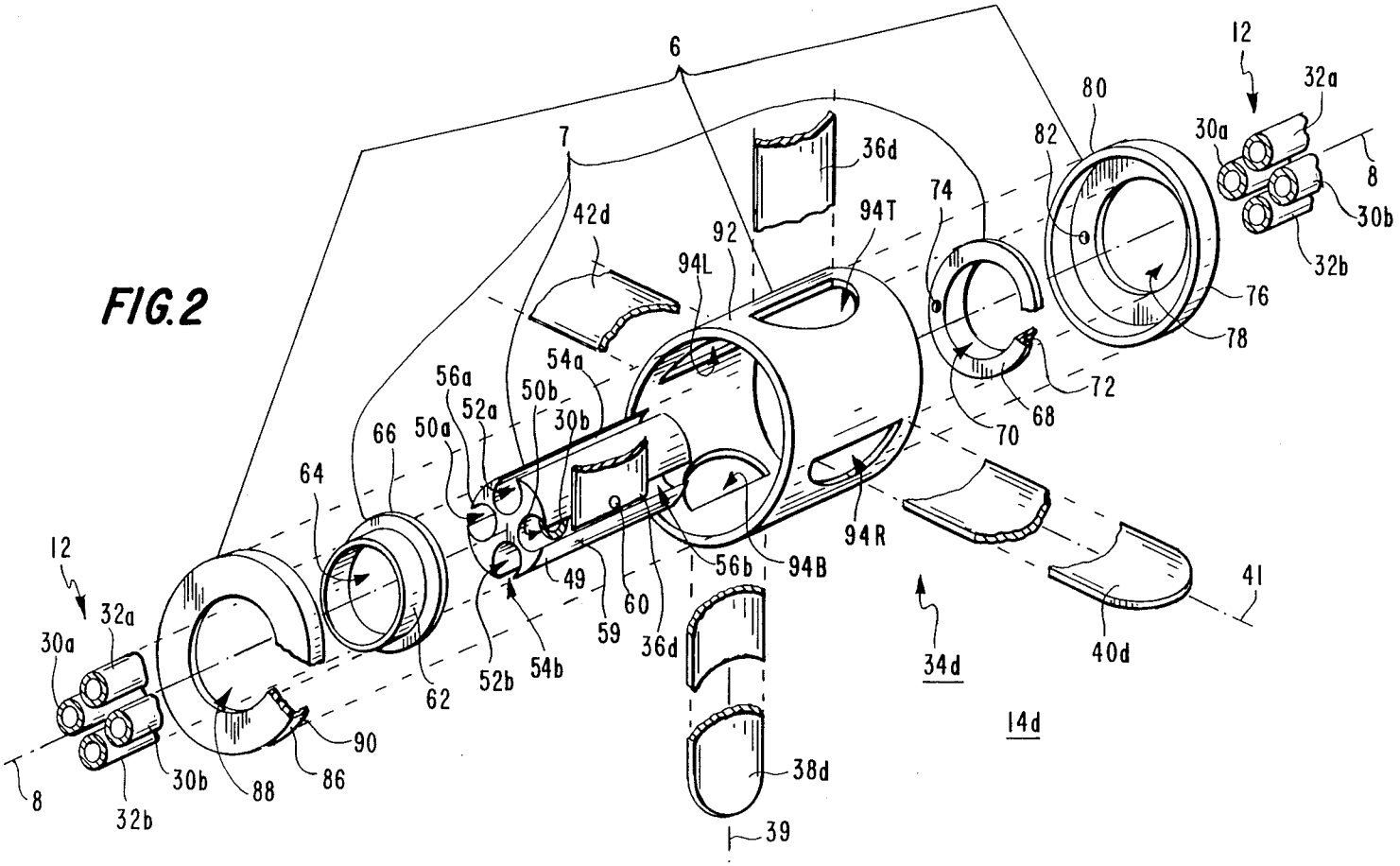
FIG. 2 is a perspective or isometric view, exploded and partially cut away, of one bay of the antenna of FIG. 1*a*.

FIG. 2 is an exploded perspective or isometric view, partially cut away, of bay 14*d* of FIG. 1. In FIG. 2, feed and support structure 12 at the left of the figure clearly shows the structure of the transmission line portion of assembly 12, including elongated upper and lower tubular conductive members 32*a* and 32*b*, and left and right tubular conductive members 30*a* and 30*b*. Conductive members 30*a* and 30*b* coact to form a balanced two-wire transmission line, and members 32*a* and 32*b* form a second balanced transmission line. As described below, coaxial cables 22*a* and 22*b* (FIG. 10) extend through tubular conductors 32*a* and 30*a* respectively.

In FIG. 2, a central dielectric member 49 is in the shape of a cylinder centered on axis 8. Dielectric member 49 defines a cylindrical outer surface 59 which is sectioned or quartered by elongated longitudinal slots or gaps illustrated as 54*a*, 54*b*, 56*a* and 56*b*, defined by cylindrical bores or apertures 50*a*, 50*b*, 52*a* and 52*b*, the axes of which are parallel with axis 8. Apertures 50*a*, 50*b*, 52*a* and 52*b* are dimensioned to closely fit around conductors 30*a*, 30*b*, 32*a* and 32*b*, respectively, of feed and support structure 12 to support the conductors at an appropriate spacing. A portion of tubular conductor 30*b* is illustrated within tubular bore 50*b*. As described in detail below, one end of upper vertical antenna element 36*d* is mechanically and electrically fastened through slot 56*b* to conductor 30*b*, as by a rivet, the head 60 of which is visible in FIG. 2. Other antenna elements 38*d*, 40*d* and 42*d* similarly have their ends (not illustrated) adjacent support member 49 connected through slots to other tubular members.

A dielectric annular member 62 includes a bore 64 dimensioned to fit closely over one end of cylindrical support 49 and the surfaces of tubular members 30*a*, 30*b*, 32*a* and 32*b* exposed through slots 56*a*, 56*b*, 54*a* and 54*b*, respectively. Annular member 62 includes a radially projecting flange 66. A similar annular member 68 includes a bore 70 adapted for closely fitting over the other end of cylindrical support member 49, and includes a radial flange 72. Additionally, annular member 68 includes a locking aperture 74 formed in flange 72, the function of which is described below. Cylindrical support member 49, and annular pieces 62 and 68 together make up a central cylindrical support 7 which holds conductive transmission lines 30*a*, 30*b*, 32*a* and 32*b* at their proper spacing and which also provides a bearing surface and guidance for the winding of the spring dipole elements, as described below. Annular members 62 and 68 are rigidly connected to the ends of cylindrical support member 49, as with adhesive.

A rotary retainer 6 for the spring elements includes an annular dielectric member 76 defining a central aperture 78 dimensioned for a moveable or rotating fit over the body of annular member 68, and also includes a similar annular member 86 defining a central aperture 88 dimensioned to rotatably fit over the body of annular member 62, and further includes a cylindrical circumferential band 92 which connects to flanges 80 and 90 of annular members 76 and 86, respectively. The assembled relationship of these elements is illustrated in cross-sectional view in FIG. 3*c*. Circumferential band 92 is rigidly fastened to annular pieces 76 and 86, so that these three pieces, together forming retainer 6, define a hollow drum which rotates about the central cylindrical support 7 including central support member 49.

Figure 3A:
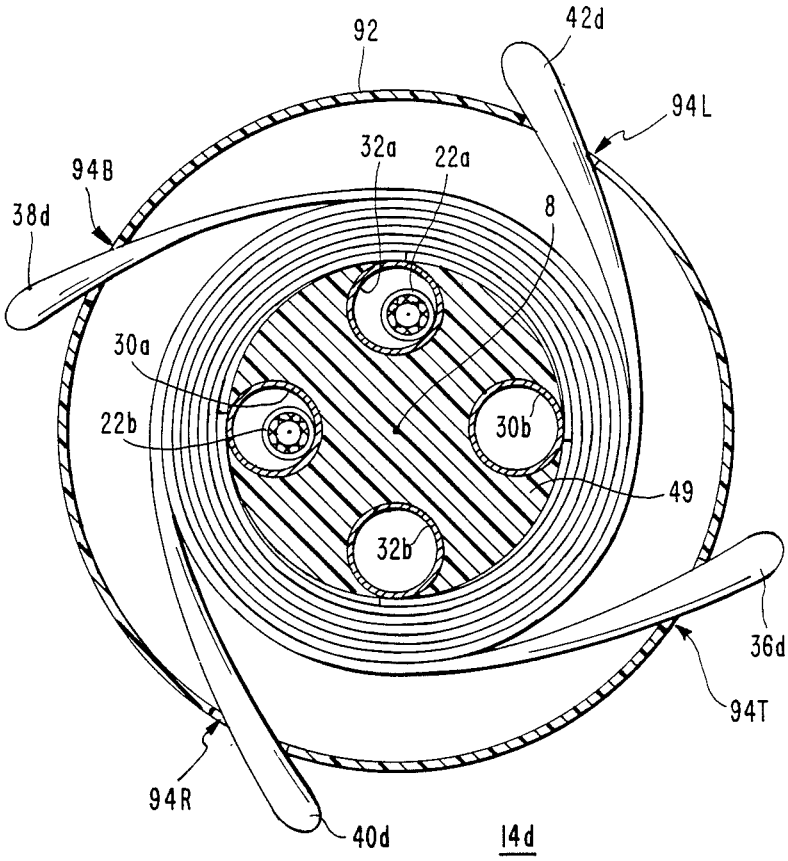
FIGS. 3*a* and 3*b* are axial cross-sectional views of the bay of FIG. 2 in its assembled form, in wound and deployed states, respectively.
Figure 3B:
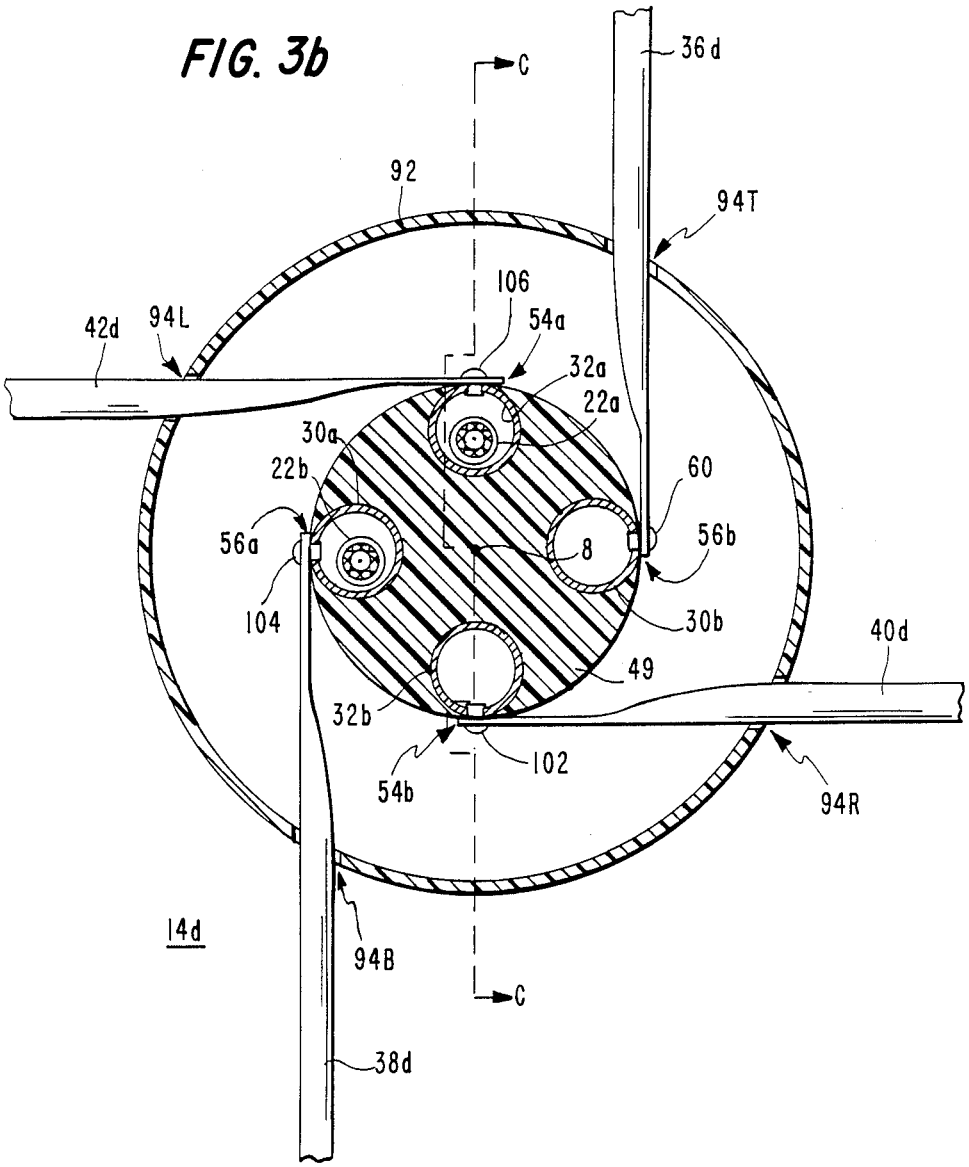
Figure 3C:
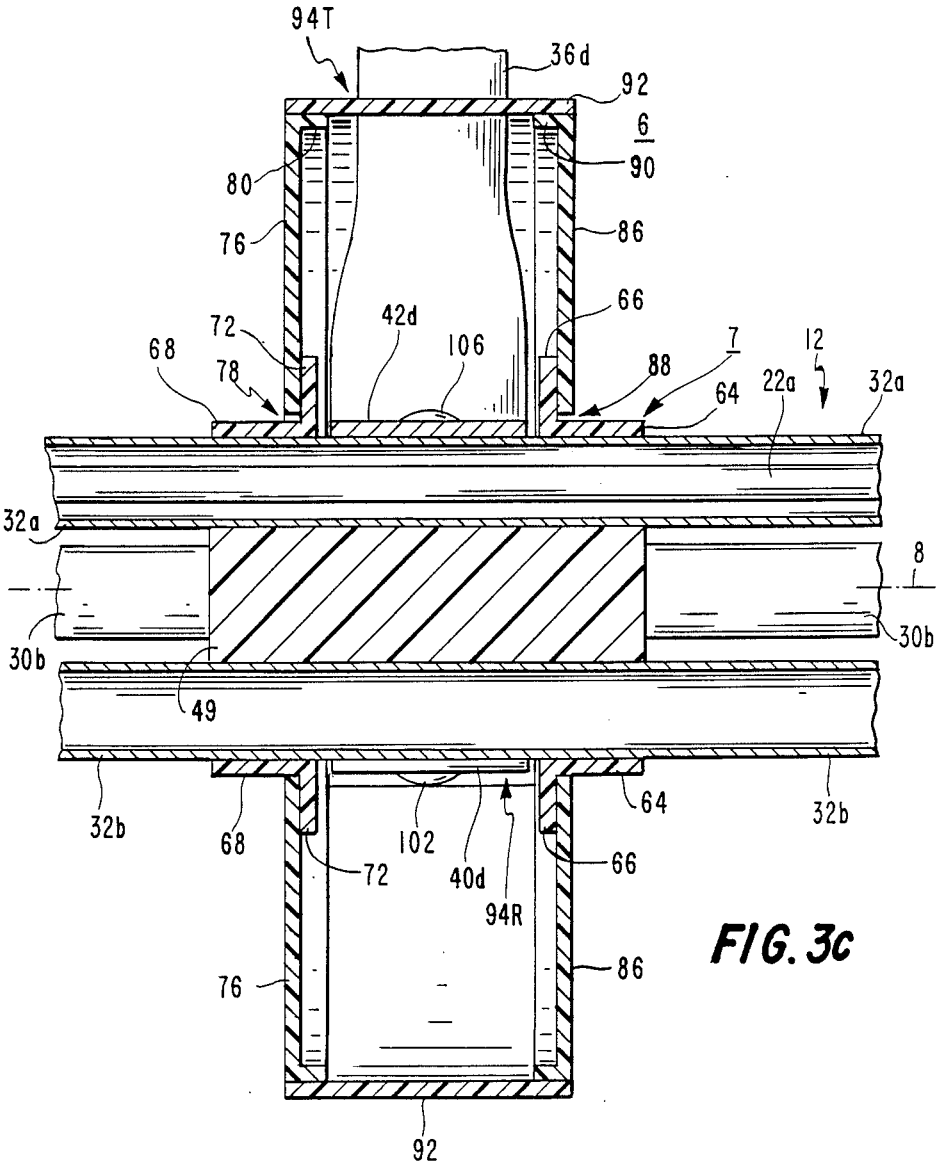
FIG. 3*c* is a longitudinal cross-section of the bay of FIG. 3*b*.

Referring to FIGS. 2, 3*b* and 3*c*, circumferential band 92 defines four orifices or apertures designated 94T (top), 94B (bottom), 94R (right) and 94L (left). The designations T, B, R and L refer to the positions of the orifices as illustrated in FIG. 2. Top vertical dipole element 36*d* passes through orifice 94T and connects to conductive tube 30*b*through slot 56*b* by means of rivet 60, as best illustrated in FIG. 3*b*. Bottom vertical dipole element 38*d* passes through orifice 94B and connects to conductive tubular member 30*a*, in a similar manner. Right horizontal dipole element 40*d* extends through orifice 94R and connects through slot 54*b* to conductive tubular member 32*b*. Left dipole element 42*d* extends through orifice 94L and connects to tubular member 32*a*. Thus, the designations T, B, R and L associated with orifices 94 also relates to the deployed orientation of the dipole element which extends therethrough.

Rotating annular member 76 also includes a second locking aperture 82 located on the body thereof in such a manner that locking apertures 74 and 82 are aligned at a particular rotational position of annular member 76 relative to annular member 68.

FIG. 3*a* illustrates bay 14*d* in axial section under a condition in which retainer 6 including circumferential band 92 is rotated counterclockwise relative to the central cylindrical support assembly 7 including central support member 49 and annular members 62 and 68. As illustrated in FIG. 3*a*, the counterclockwise rotation has caused the spring elements to wind about central support member 49 in a spiral pattern, tending to flatten the bowed shape. At those locations at which the dipole elements such as dipole element 38*d* leave the spiral winding to extend through their associated apertures, such as aperture 94B in the case of element 38*d*, the spring element assumes it natural bowed state, which in the view of FIG. 3*a* takes on the appearance of greater thickness.

Also visible in FIG. 3*a* are flexible coaxial conductors 22*a* and 22*b*, which run the length of the interior of tubular members 32*a* and 30*a*, respectively. Details of the connections of flexible coaxial cables 22*a* and 22*b* appear below in conjunction with FIGS. 5*a* and 5*b*.

FIG. 3*b* is a cross-section similar to that of FIG. 3*a*, but in a condition in which retainer 6 including circumferential band 92 has been released, and the energy stored in the wound spring elements illustrated in FIG. 3*a* has been released to unwind the spring elements by rotation of retainer 6. As illustrated in FIG. 3*b*, spring dipole element or member 36*d* assumes a vertical position which results from its being fastened to a vertical surface of tubular member 30*b*. Similarly, lower vertical spring dipole element 38D, illustrated as being riveted by a rivet 104 to a vertical surface of tubular member 30*a*, extends downward. Spring elements 40*d* and 42*d*, being riveted by rivets 102 and 106, respectively, to horizontal surfaces of tubular members 32*b* and 32*a*, respectively, extend horizontally as shown.

Figure 3D:
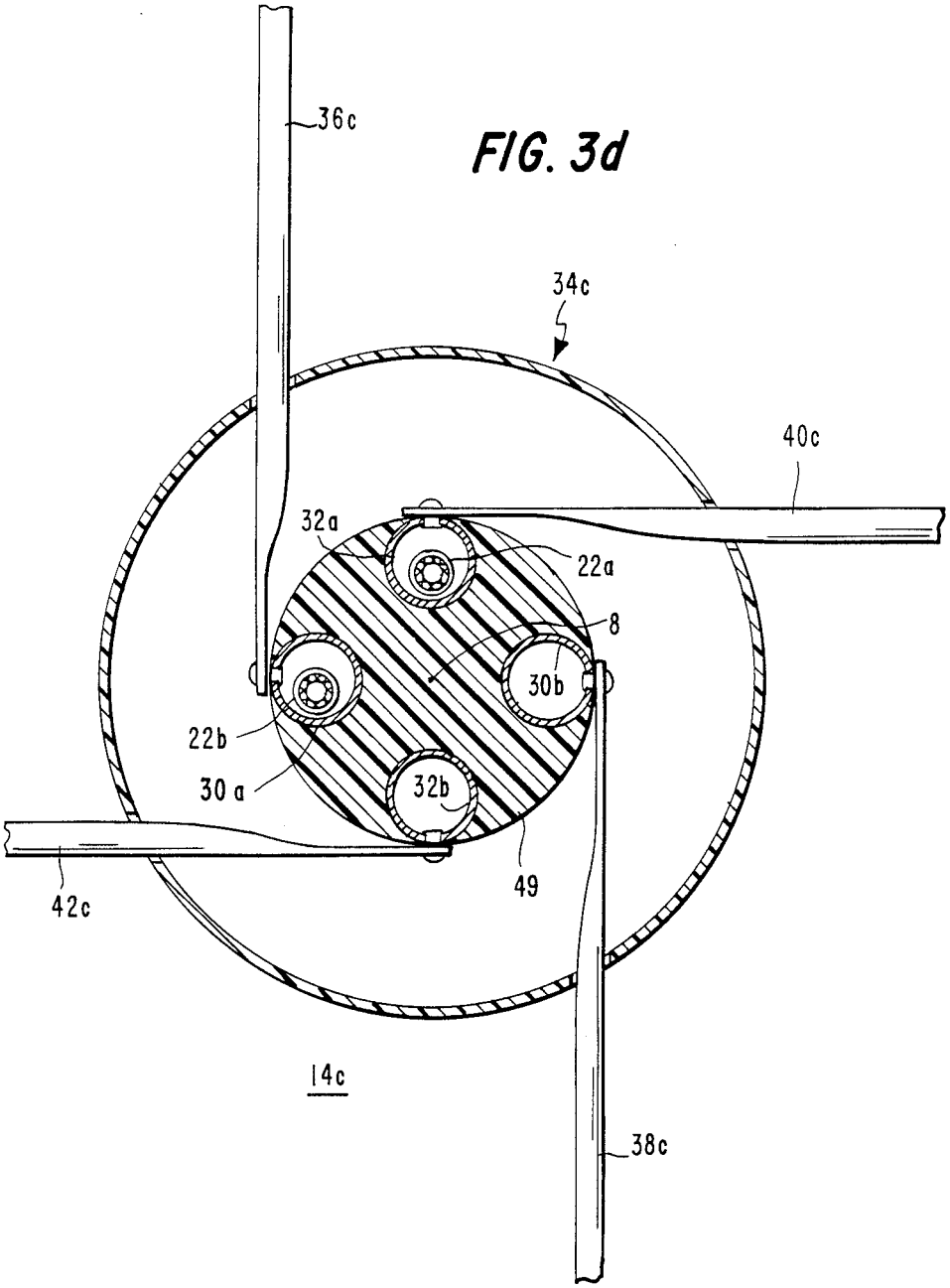
FIG. 3*d* is a similar axial cross-sectional view of a bay of the antenna of FIG. 1 adjacent the bay illustrated in FIGS. 3*a*, 3*b* and 3*c*, illustrating the alternation of connection of the elements.

FIG. 3*d* is a cross-section similar to that of FIG. 3*b*, but representing bay 14*c* of FIG. 1, which is adjacent to bay 14*d*. As illustrated in FIG. 3*d*, top vertical element 36*c* projects upward from its connection to tubular member 30*a*, and it is therefore somewhat to the left of a vertical plane which passes through axis 8 by comparison with top vertical member 36*d* of FIG. 3*b*. The offset from the vertical plane passing through longitudinal axis 8 is relatively small and does not appreciably degrade the antenna operation. Such offsets appear, for example, in the aforementioned Brown et al article. In FIG. 3*d*, lower vertical member 38*c* connects to the right side of tubular member 30*b*, and is therefore offset to the right from a vertical plane passing through axis 8. Similarly, right and left horizontal elements 40*c* and 42*c* are above and below a horizonal plane passing through axis 8, respectively, because of their connection to upper and lower surfaces, respectively, of tubular members 32*a* and 32*b*.

The structure as so far described includes electrically conductive spring dipole elements physically connected to a support structure, with a rotatable retainer which engages the spring elements which can be rotated relative to the central support structure to thereby wind the spring elements about the support structure, storing energy therein. When the retainer is released, the spring elements unwind, to assume their deployed position. It may be desirable during transport or storage to maintain the antenna in its undeployed state with its spring elements wound within the retainer. For this purpose, a locking arrangement must be provided to prevent the elements from deploying to their natural state.

Figure 4A:
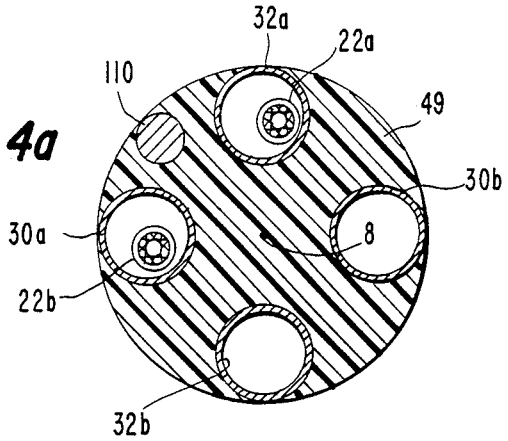
FIG. 4*a* illustrates a cross-section of the support structure of a bay of another embodiment of the invention including a deployment locking bar.
Figure 4B:
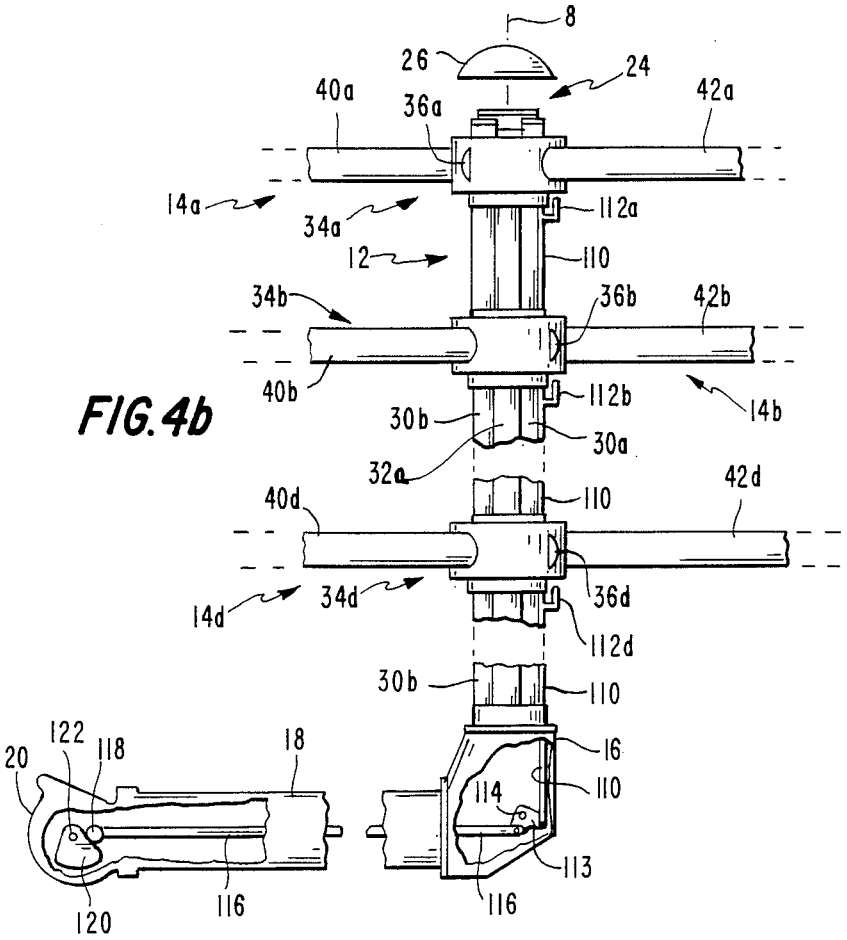
FIG. 4*b* is a elevation view of log periodic dipole array similar to that of FIG. 1 but incorporating the locking bar of FIG. 4*a*, illustrating details of the locking arrangement and its connection to hinges of the support structure.

FIG. 4*a* illustrates a cross-section of the central support member 49 of a bay of an antenna similar to antenna 10 of FIG. 1*a*, modified to include a bore parallel to longitudinal axis 8 through which a rod 110 extends in a longitudinally moveable manner. Rod 110 may be of a nonconductive material. The location of rod 110 illustrated in FIG. 4*a* is sufficiently outside the main portion of the transmission lines formed by conductor pairs 30*a*, 30*b*; 32*a*, 32*b* so that even if rod 110 is made from a conductive material the characteristics of the transmission lines are not significantly affected FIG. 4*b* is a plan view of the antenna structure illustrated in FIG. 1, modified according to FIG. 4*a*, and developed so that elbow 16, support pipe 18 and hinge 20 lie in the same plane as horizontal dipole elements 40 and 42. In FIG. 4*b*, longitudinal rod 110 can be seen at the right of feed and support structure 12. Also visible in FIG. 4*b* are offset hooks or pins 112*a*, 112*b*...112*d* illustrated in their retracted position, in which retracted position they do not restrain the retainers 7 against rotation. In the alternate position of locking rod 110, locking pins 112*a*, 112*b*...112*d* pass through locking apertures, such as apertures 82 and 74 of annular members 68 and 76 of FIG. 2. When locking pins such as 112*d* are so engaged, they are fixed against lateral movement, whereby the rotatable retainers are fixed against rotation relative to the stationary support structure. This prevents the spring dipole elements from unwinding and prevents deployment.

Locking actuation rod 110 is coupled at its support end (the end of feed and support structure 12 adjacent support elbow 16) to a link 113, which pivots about a fixed pin 114 in response to axial motion of a second actuating rod 116. Actuating rod 116 extends through support pipe 18 and terminates in a rounded or roller end 118 which bears against the surface of a cam 120 fixed to an axis 122. Axis 122 is the axis of rotation of hinge 20. Actuating rod 116 is urged to the left by a spring (not illustrated in FIG. 4*b*). In the stowed position (not illustrated) of the antenna illustrated in FIG. 4*b*, hinge 20, support tube 18, elbow 16 and the entire active portion of the antenna are rotated 90° clockwise relative to axis 122. In this position, rounded end 118 of actuating rod 116 bears against the raised lobe of cam 120, thereby pivoting link 113, which assumes its alternate position to that one shown, in which position it causes lock actuating rod 110 to assume the forward position and engage locking pins 112 in apertures 74 and 82 of FIG. 2. Thereafter, so long as the antenna and its support structure is not rotated relative to axis 122, locking rod 116 is maintained in position on the high portion of cam 120, and locking pins 112 remain engaged to lock the retainers of the various bays of the antenna against the rotation. When the antenna and support structure is rotated about axis 122 so that actuating rod 116 comes off the high point of the cam, the locking pins disengage, thereby allowing the retainers to rotate, whereupon the wound spring elements expend their energy in deploying. The mutual contrarotation of alternate bays tends to minimize any net torque about axis 8.

Figure 5A:
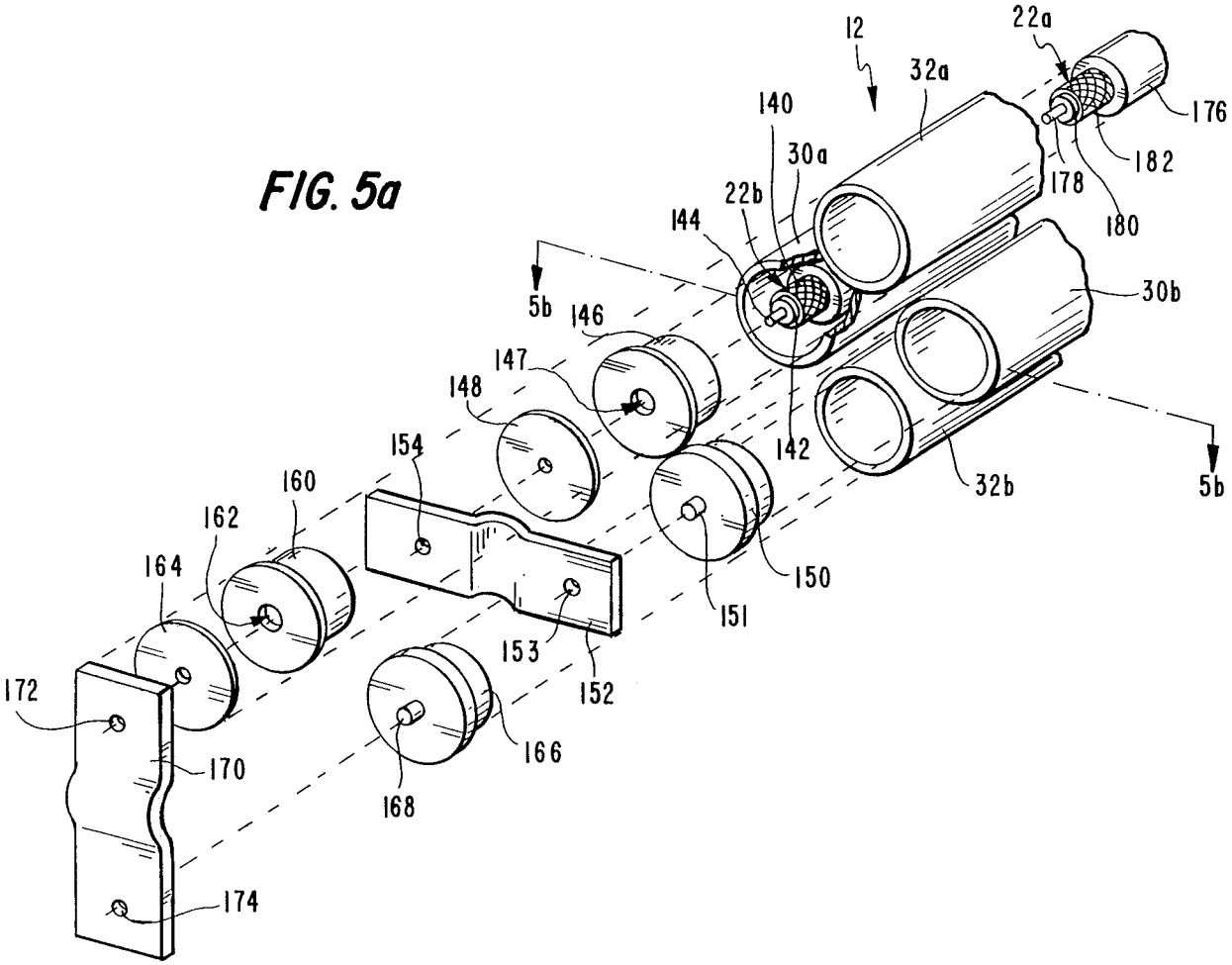
FIG. 5*a* is an exploded view illustrating details at the feed end of the transmission line structure of the antenna of FIG. 1*a*.
Figure 5B:
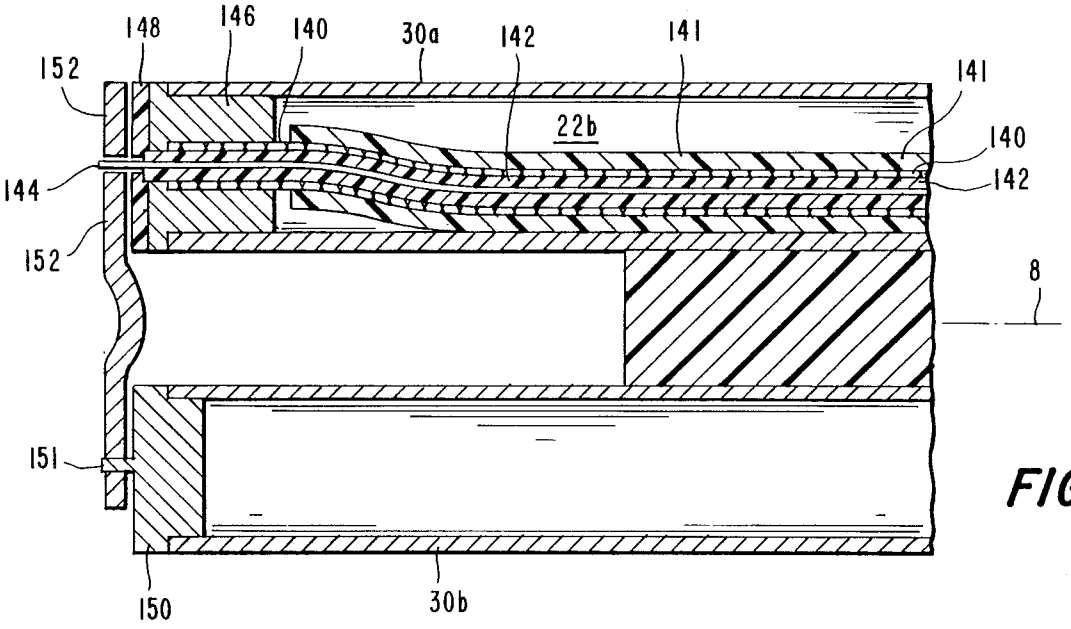
FIG. 5*b* is a cross-section thereof in its assembled form.

FIGS. 5*a* and 5*b* are, respectively, exploded perspective or isometric views and cross-sectional views, respectively, of the electrical feed connections at feed end 24 of feed and support structure 12. As illustrated in FIGS. 5*a* and 5*b*, flexible coaxial cables 22*a* and 22*b* extend through tubular conductive members 32*a* and 30*a*, respectively. The center conductors and braided outer conductors of cables 22*a* and 22*b* are exposed. Connection is made between outer conductor 140 of coaxial cable 22*b* and conductive member 30*a* by a conductive annular bushing 146. The inner diameter of a bore 147 of bushing 146 is dimensioned to fit snugly over the outer conductor braid 140 of coaxial cable 22*b*, and is conductively fixed ("soldered") thereto. The outer diameter of bushing 146 fits snugly within the entrance of tube 30*a*, with dielectric material 142 of coaxial cable 22*b* slightly protruding from bore 147. A dielectric washer 248 fits over dielectric material 142 protruding from bore 147, to space a conductive jumper 152 away from exposed portions of conductive bushing 146. A plug 150 with a protruding pin 151 is soldered or otherwise conductively affixed within the end of tube 32*b*, with a pin 151 protruding therefrom by about the same amount as center conductor 144 of coaxial cable 22*b* extends above washer 148. Finally, an aperture 154 of jumper 152 is placed over center conductor 144 of coaxial cable 22*b*, and aperture 153 of jumper 152 is placed over pin 151 of plug 150, and both connections are soldered. Those skilled in the art will recognize these connections as connections of the horizontal dipoles in the manner described in the Isbell patent.

The upper and lower tubes 32*a* and 32*b* are similarly connected to the center and outer conductors 178 and 182, respectively, of coaxial cable 22*a*, with the aid of a bushing 160 which fits within the end of conductive tube 32*a*, with its bore 162 soldered to outer conductor 182. A dielectric washer 164 spaces a jumper 170 away from annular member 160. Plug 166 fits within tube 32*b* with its pin 168 protruding, and apertures 174 and 172 of jumper 170 respectively fit over pin 168 and center conductor 178.

FIG. 1*b* illustrates the end of one of the dipole elements of an alternate embodiment of the antenna, in which each dipole element 250 has a conductive end load 260 which is formed in such a manner that it lies flat against the outer surfaces of circumferential band 92 when the element is completely retracted. This may also aid in preventing over-retraction of a dipole element.

Other embodiments of the invention will be apparent to those skilled ion the art. For example, the spring dipole elements may be flat rather than bowed, or they may be bowed but dimensioned so that winding does not cause significant flattening of the elements. A five-bay antenna has been described, but any number of bays may be used, depending on the desired radiation characteristics and bandwidth The same principles may be applied to planar log-periodic dipole arrays or to monopole arrays, or to single monopole antennas. Straight dipole elements are illustrated, but in principle curved elements may be used.

What is claimed is:

1. A deployable antenna apparatus comprising:

an elongated electrically conductive first spring-like tape element defining an axis of elongation and forming at least a part of the antenna;

a generally cylindrical support structure defining a cylinder and having a cylinder axis and a support surface;

mechanical coupling means for coupling a first end of said element to a first location on said cylinder, with said axis of elongation lying in a plane perpendicular to said cylinder axis;

a feed conductor coupled to said element near said first end;

a retainer including first and second generally annular sides spaced apart by a circumferential band, said first and second annular sides each defining a central aperture bearing against said support surface and rotatable relative thereto, said circumferential band having a first orifice larger than the cross-section of said element, said element extending through said first orifice, whereby rotation of said retainer relative to said support structure causes said element to wind about said support structure, and the energy stored in said element by said rotation provides for deployment, said circumferential band further having;

a second orifice, said second orifice being diametrically opposed to said first orifice relative to said cylinder axis;

an elongated, electrically conductive second element substantially like said first element, said second element extending through said second orifice and having a first end mechanically coupled to said support surface at a second location diametrically opposite to said first location relative to said cylinder axis; and a second feed conductor coupled to said second element near said first end of said second element.

2. A deployable antenna apparatus comprising:

an elongated electrically conductive first spring-like tape element defining an axis of elongation and forming at least a part of the antenna;

a generally cylindrical support structure defining a cylinder and having a cylinder axis and a support surface;

mechanical coupling means for coupling a first end of said element to a first location on said cylinder, with said axis of elongation lying in a plane perpendicular to said cylinder axis;

a feed conductor coupled to said element near said first end;

a retainer including first and second generally annular sides spaced apart by a circumferential band, said first and second annular sides each defining a central aperture bearing against said support surface and rotatable relative thereto, said circumferential band having a first orifice larger than the cross-section of said element, said element extending through said first orifice, whereby rotation of said retainer relative to said support structure causes said element to wind about said support structure, and the energy stored in said element by said rotation provides for deployment, said retainer further having a locking aperture;

a locking means coupled to said support structure and to said locking aperture, said locking aperture defining an axis parallel to said cylinder axis, said locking means further including;

movable engaging means which is moveable parallel to said cylinder axis relative to said support structure for engaging said locking aperture in one position and for disengaging said locking aperture in a second position.

3. A deployable multiple-bay antenna apparatus, comprising:

a straight, elongated transmission line adapted to be fed from a feed end, said transmission line including elongated mutually parallel electrical first and second conductors equally spaced from a longitudinal axis;

a first support structure mechanically coupled at a first location along said transmission line, said first support structure defining a generally cylindrical first support surface centered on said longitudinal axis;

an elongated, electrically conductive first spring-like tape element, said first element being substantially straight in its natural state, said first element being electrically connected at one end to said first conductor of said transmission line;

a first retainer associated with said first support structure and said first element to define a first bay of the multiple-bay antenna, said first retainer including first and second generally flat annular sides spaced apart by a circumferential band, said first and second annular sides each defining a central aperture bearing against and rotatable relative to said first support surface, said circumferential band of said first retainer defining a first orifice through which said first element extends;

a second support structure mechanically coupled at a second location along said transmission lines, said second location being spaced by a first separation from said first location, said second support structure defining a generally cylindrical second support surface centered on said longitudinal axis;

an elongated, electrically conductive second element, said second element being substantially straight in its natural state, said second element being electrically connected at one end to said second conductor of said transmission line;

a second retainer associated with said second support structure and said second element to define a second bay of said multiple-bay antenna, said second retainer including first and second generally flat annular sides spaced apart by a circumferential band, said first and second annular sides of said second retainer each defining a central aperture bearing against and rotatable relative to said second support surface, said circumferential band of said second retainer defining a first orifice through which said second element extends.

4. An apparatus according to claim 3 wherein said second element is longer than said first element.

5. An apparatus according to claim 3 wherein said first and second elements are wound about said first and second support surfaces, respectively.

6. An apparatus according to claim 5 wherein said first element is wound about said first support surface in a clockwise direction as viewed from said feed end of said transmission line, and said second element is wound about said second support surface in a counterclockwise direction as viewed from said feed end.

7. An apparatus according to claim 3 wherein said first element when in said natural state has, in a plane perpendicular to the axis of elongation of said first element, a cross-sectional shape which is a generally thin bowed rectangle.

8. An apparatus according to claim 3, wherein said circumferential bands of each of said first and second retainers each have a second orifice at a location diametrically opposite to said first orifice relative to said longitudinal axis of said transmission line, and further comprising:

elongated, electrically conductive third and fourth elements identical to said first and second, elements respectively, said third and fourth elements being electrically connected at one end to said second and first conductors of said transmission line, respectively, said third and fourth elements extending through said second orifices of said first and second retainers, respectively.

9. An apparatus according to claim 8 wherein said first, second, third and fourth elements when in their natural state have, in a plane perpendicular to the axis of elongation, a cross-sectioned shape which is a generally bowed, thin rectangle.

10. An apparatus according to claim 8 wherein said circumferential bands of said first and second retainers each have third and fourth mutually diametrically opposed orifices equally angularly spaced about said longitudinal axis relative to said first and second orifices, and further comprising:

a second straight, elongate transmission line including elongated mutually parallel first and second electrical conductors equally spaced from said longitudinal axis, said first and second conductors of said first and second transmission lines being equally angularly spaced about said longitudinal axis;

fifth and sixth elements each identical to said first elements, said fifth element being electrically connected at one end to said first conductor of said second transmission line and extending through said third orifice of said first retainer, said sixth element being electrically connected at one end to said second conductor of said second transmission line and extending through said fourth orifice of said first retainer;

seventh and eight elements, each identical to said second element, said seventh element being electrically connected at one end to said second conductor of said second transmission line and extending through said third orifice of said second retainer, said eighth element being electrically connected at one end to said first conductor of said second transmission line and extending through said fourth orifice of said second retainer.

11. An apparatus according to claim 10, wherein said second element is longer than said first element.

12. An apparatus according to claim 10 wherein said elements are wound about said support surfaces.

13. An apparatus according to claim 12, wherein said first, third, fifth and sixth elements are wound about said first support structure in a clockwise direction as viewed from one end of said longitudinal axis, and said second, fourth, seventh and eighth elements are wound about said second support structure in a counterclockwise direction as viewed from said one end of said longitudinal axis.

14. An apparatus according to claim 13 wherein said second element has a length different from that of said first element, and further comprising:

a third support structure substantially like said first support structure, said third support structure being mechanically coupled to said transmission line at a third location along said transmission line, said third location being more remote from said first location than from said second location, said third location being spaced by a second separation from said second location, said second separation being larger than said first separation;

a third retainer substantially like said first retainer, said third retainer being associated with said third support structure and with a third element to define a third bay of said multiple-bay antenna;

said third element being substantially like but longer than either said first or said second elements, said third element being electrically connected at one end to said first conductor of said transmission line.

15. An apparatus according to claim 3 further comprising:

movable rotation restraining means coupled to said first and second support structures and to said first and second retainers for, in a first position, locking said first and second retainers against rotation relative to said first and second support structures, and in a second position, allowing said first and second retainers to rotate relative to said first and second support structures, respectively, whereby said first and second elements may be deployed.

16. A deployable crossed log-periodic antenna, comprising:

first and second substantially independent elongated two-wire transmission lines centered on a longitudinal axis, said first and second transmission lines extending in the same direction along said longitudinal axis from their feed ends;

a plurality of bays spaced along and electrically coupled to said first and second transmission lines, said bays being spaced from each other by separations which increase with increasing distance from said feed ends, each of said bays comprising four elongated conductive spring-like tape elements in matched pairs, the elements of one pair of elements of each bay having the same length and being electrically fed by one of said first and second transmission lines, the elements of the other pair of elements of each bay having the same length and being electrically fed by the other one of said first and second transmission liens, each of said bays also including an element retaining means rotatable about said longitudinal axis and mechanically engaged with said four elements at locations lying in a plane perpendicular to said longitudinal axis and passing through the point of electrical feed of at least one of said pairs of said elements, said retaining means being adapted, when rotated, for simultaneously winding said four elements of each bay into a coil centered on said axis and, when said retainer is prevented from rotating, for retaining said elements in said coil against the tendency of said elements to straighten.

17. An antenna according to claim 16 further comprising retainer rotation restraining means coupled to said retaining means of each of said bays for restraining said retaining means against rotation in a first mode of operation and for simultaneously enabling all of said retaining means for rotation in a second mode of operation.

* * * * *